US005295423A

United States Patent [19]

Mikic

[11] Patent Number: 5,295,423

[45] Date of Patent: Mar. 22, 1994

[54] BIT WITH FRICTIONAL RETENTION IN DRIVE SOCKET

[75] Inventor: Frank Mikic, Kenosha, Wis.

[73] Assignee: Snap-on Tools Corporation, Kenosha, Wis.

[21] Appl. No.: 970,110

[22] Filed: Nov. 2, 1992

[51] Int. Cl.[5] ..... B25B 23/00

[52] U.S. Cl. ..... 81/438; 81/177.85; 279/102

[58] Field of Search ..... 81/124.6, 177.85, 438; 279/102, 104

[56] References Cited

U.S. PATENT DOCUMENTS

| | | | |
|---|---|---|---|
| 386,040 | 7/1888 | Sublett | 279/104 |
| 1,273,379 | 7/1918 | Knudson | 279/104 |
| 1,841,688 | 1/1932 | Vlchek | 279/104 X |
| 2,018,376 | 10/1935 | McMenamin | 279/104 |
| 3,253,626 | 5/1966 | Stillwagon, Jr. et al. . | |
| 3,455,355 | 7/1969 | McLogan et al. | 81/438 |
| 3,683,984 | 8/1972 | Hull . | |
| 4,266,453 | 5/1981 | Farley . | |
| 4,779,493 | 10/1988 | White . | |
| 5,050,467 | 9/1991 | Brown et al. . | |

*Primary Examiner*—James G. Smith
*Attorney, Agent, or Firm*—Emrich & Dithmar

[57] ABSTRACT

A polygonal bit is frictionally retained in a mating socket opening of a drive socket by the provision of recesses in the flat surfaces of the bit, the formation of each recess creating a raised ridge of material displaced from the recess and projecting from the flat surface around the perimeter of the recess for frictional engagement with the corresponding drive surface of the drive socket. Recesses may be formed in flat surfaces on opposite sides of the bit, with one or two recesses being formed in each such surface. Various shapes of recess are disclosed.

20 Claims, 1 Drawing Sheet

BIT WITH FRICTIONAL RETENTION IN DRIVE SOCKET

BACKGROUND OF THE INVENTION

1. Field of the Invention

The present invention relates to driven members, such as tool bits or the like, and in particular to means for retaining such a driven member in an associated drive socket.

2. Description of the Prior Art

Various techniques have heretofore been used for retaining driving and driven members in coupling engagement with each other. A standard technique for coupling a driven bit to a drive socket is the use of a coupling pin extending diametrically through the two intercoupled members. This has the disadvantage of requiring a separate part. Also, the bit and drive socket must have diametrical holes therethrough which are substantially perfectly aligned and accurately sized relative to the pin, otherwise the pin may become loose and fall out or may be sheared in use. Furthermore, the design is costly to manufacture.

Other retention schemes utilize a spring-biased ball in the bit which is engageable in a complementary recess or groove in the socket. This, again, is a complex and costly construction involving the assembly of multiple parts.

SUMMARY OF THE INVENTION

It is a general object of the invention to provide an improved technique for retaining a driven bit in an associated drive socket, which avoids the disadvantages of prior techniques while affording additional structural and operating advantages.

An important feature of the invention is the provision of a bit which can be retained in an associated drive socket with no additional parts.

Still another feature of the invention is the provision of a bit of the type set forth, which can be retained in an associated drive socket with no modification of the socket.

Yet another feature of the invention is the provision of a bit of the type set forth which is of simple and economical construction.

These and other features of the invention are attained by providing a bit comprising: an elongated solid body substantially polygonal in transverse cross section, the body having a plurality of substantially flat planar surfaces intersecting at a plurality of corners, a recess formed in at least one of the flat surfaces, and a raised ridge of material displaced from the recess and projecting from the associated one of the flat surfaces around the perimeter of the recess.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figures 1, 2, 3, 4, 5, 6, 7, 8, 9, 10, 11, 12, 13, 14:
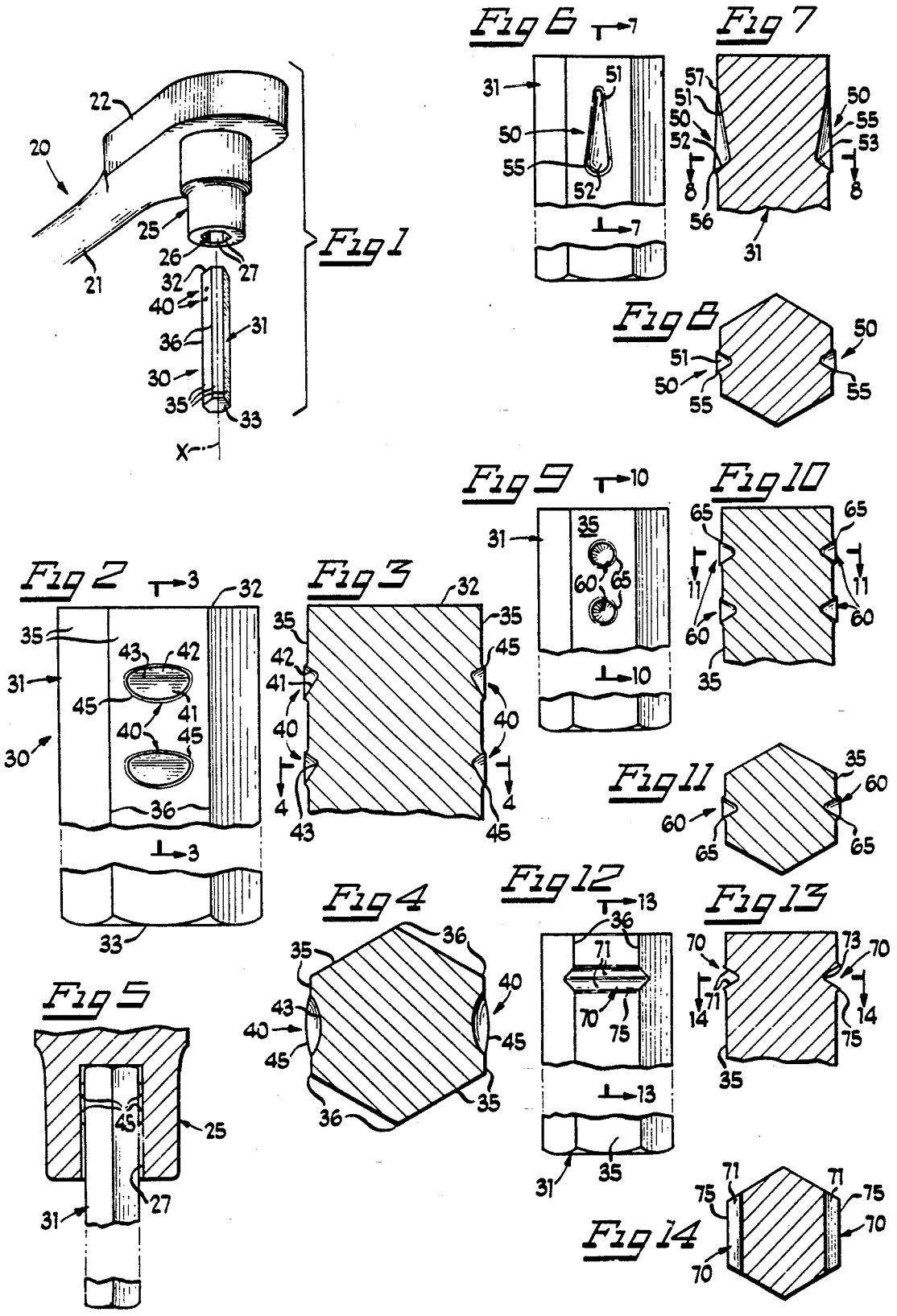
FIG. 1 is a fragmentary perspective view of a bit constructed in accordance with a first embodiment of the present invention and disposed for coupling engagement in an associated drive socket.
FIG. 2 is an enlarged side elevational view of the bit of FIG. 1, with portions removed.
FIG. 3 is a fragmentary view in vertical section taken along the line 3—3 in FIG. 2.
FIG. 4 is a view in horizontal section taken along the line 4—4 in FIG. 3.
FIG. 5 is a reduced fragmentary view of the bit of FIG. 2 engaged in an associated drive socket, with portions broken away to more clearly illustrate the inter-engagement.
FIG. 6 is a reduced view similar to FIG. 2, illustrating an alternative embodiment of the present invention.
FIG. 7 is a fragmentary view in vertical section taken along the line 7—7 in FIG. 6.
FIG. 8 is a view in horizontal section taken along the line 8—8 in FIG. 7.
FIG. 9 is a view similar to FIG. 6 illustrating another embodiment of the invention.
FIG. 10 is a fragmentary view in vertical section taken along the line 10—10 in FIG. 9.
FIG. 11 is a view in horizontal section taken along the line 11—11 in FIG. 10.
FIG. 12 is a view similar to FIG. 6 illustrating yet another embodiment of the invention.
FIG. 13 is a fragmentary view in vertical section taken along the line 13—13 in FIG. 12.
FIG. 14 is a view in horizontal section taken along the line 14—14 in FIG. 13.

Referring to FIG. there is illustrated a wrench 20 which may, for example, be a ratchet wrench, including a handle 21 and a wrenching head 22. The head 22 is provided with a drive lug (not shown) adapted to be engaged with one end of a drive socket 25, the other end of which is provided with a socket opening 26. The socket opening 26 is preferably polygonal in shape, the illustrated socket 25 having a hexagonal socket opening 26 defining six drive surfaces 27.

Referring also to FIGS. 2-5, the socket 25 is adapted for driving engagement with an associated bit 30 constructed in accordance with a first embodiment of the present invention. More specifically, the bit 30 includes an elongated solid body 31 substantially hexagonal in transverse cross section and dimensioned to be mateably received in the socket opening 26 of the drive socket 25. The bit body 31 has opposed ends 32 and 33 and defines six flat, planar, outer surfaces 35 intersecting at corners 36 and extending between the ends 32 and 33, all in a known manner. It will be appreciated that the bit 30 is dimensioned so as to be mateably receivable in the socket opening 26 in close-fitting relationship for driven engagement therewith, in a known manner.

Typically, with prior art bits, because of the slight clearance space between the bit and the drive surfaces 27 to permit insertion and removal of the bit, there is a small amount of "play" so that, in use, there is a slight rotational movement of the drive socket 25 relative to the bit before the two are brought into driving engagement with each other, so that the corners 36 of the bit engage the drive surfaces 27 of the drive socket 25, all in a known manner.

The bit 30 is provided with four recesses 40 adjacent to one end 32 thereof, with two of the recesses 40 being formed in each of opposed ones of the flat surfaces 35, at longitudinally spaced-apart locations thereon, and positioned so that they will be received completely within the socket opening 26 when the bit 30 is inserted therein. The recesses 40 are all of identical construction. Each recess 40 is generally oval in shape at the outer perimeter thereof bu is non-symmetrical, so as to include a relatively long side 41 and a relatively short side 42 which intersect along a crease line 43 which lies in a transverse plane disposed substantially perpendicular to the longitudinal axis "X" of the body 31. When the recess 40 is formed, material is displaced from the bit body 31 to define a raised ridge 45 which projects outwardly from the associated flat surface 35 around the perimeter of the recess 40.

In use, the ridges 45 project a sufficient distance from the associated flat surfaces 35 to substantially take up the clearance space between the bit 30 and the socket opening 26 so as to provide an interference fit between the bit 30 and the socket drive surfaces 27 when the bit 30 is inserted in the socket opening 26, thereby frictionally to retain the bit 30 in the socket opening 26.

Referring now also to FIGS. 6–8, there is illustrated an alternative embodiment of the present invention in which the bit body 31 is provided with generally teardrop-shaped recesses 50, respectively formed in two opposed ones of the flat surfaces 35. Each of the recesses 50 has an elongated tapered narrow end 51 and a short rounded wide end 52 which converge to a region 53 at the deepest part of the recess 50. In the formation of the recess 50, material is displaced to form a raised ridge 55 projecting from the associated one of the flat surfaces 35 around the perimeter of the recess 50. Because more material is displaced from the wide end 52 of the recess 50 than from the narrow end 51 thereof, the ridge 55 slopes from a high portion 56 adjacent to the wide end 52 of the recess 50 to a low portion 57 adjacent to the narrow end 51 of the recess 50, the low portion 57 projecting a negligible distance from the surface 35. This serves to provide a wedge-type frictional interference fit between the ridges 55 and the corresponding drive surfaces 27 of the drive socket 25. Because of the length of the recesses 50, only one is provided in each of the opposed surfaces 35, but it will be appreciated that additional recesses 50 could be provided if desired.

Referring also to FIGS. 9–11, there is illustrated another embodiment of the invention including generally conical recesses 60 formed in the opposed flat surfaces 35 of the bit body 31. In the disclosed embodiment, there are two of the recesses 60 on each of two opposed flat surfaces 35, with the material displaced from each of the recesses 60 defining a raised ridge 65 projecting outwardly from the associated flat surface 35 around the perimeter of the recess 60. In use, the ridges 65 function in substantially the same manner as was described above in connection with the ridges 45 of FIGS. 2–5.

In FIGS. 12–14, there is illustrated yet another embodiment of the invention, including generally V-shaped elongated recesses 70 formed, respectively, in opposed flat surfaces 35 of the bit body 31. Preferably, each of the recesses 70 extends laterally of the bit body 31 and includes converging planar sides 71 intersecting at an apex or crease line 73 at the root of the recess 70, lying in a plane substantially perpendicular to the longitudinal axis "X" of the bit body 31. The material displaced from each recess 70 forms a raised ridge 75 projecting from the associated flat surface 35 around the perimeter of the recess 70. In use, the ridges 75 function in substantially the same manner as was described above in connection with the embodiments of FIGS. 1–11.

It can be seen that each of the recesses 70 extends completely across the width of the associated flat surface 35 and a slight distance across the bordering corners 36 thereof. However, in the case of the recesses 40, 50, and 60, each recess is limited to the area of the associated flat surface 35 and does not cross any of the corners 36. This latter configuration is preferred, so as not to interfere with the driving forces exerted on the bit 30 which, as was explained above, are applied to the corners 36.

From the foregoing, it can be seen that there has been provided an improved bit construction which provides a friction-fit retention in an associated drive socket and is of simple and economical construction.

I claim:

1. A bit comprising: an elongated solid body substantially polygonal in transverse cross section, said body having a plurality of substantially flat planar surfaces intersecting at a plurality of corners, a recess formed in at least one of said flat surfaces, and a raised ridge of material displaced from said recess and projecting from the associated one of said flat surfaces around substantially the entire perimeter of said recess.

2. The bit of claim 1, wherein said body is substantially hexagonal in transverse cross section.

3. The bit of claim 1, wherein the perimeter of said recess is generally oval in shape, said recess including opposed side surfaces intersecting in a plane extending transversely of said body and being asymmetrical relative to said plane.

4. The bit of claim wherein said body includes a plurality of said recesses.

5. The bit of claim 4, wherein said body includes recesses respectively disposed in opposed ones of said flat planar surfaces.

6. The bit of claim 4, wherein said body includes more than one of said recesses in one of said flat surfaces.

7. The bit of claim 6, wherein said body includes more than one of said recesses in each of two opposed ones of said flat surfaces.

8. The bit of claim 1, wherein said recess is generally conical in shape.

9. The bit of claim 1, wherein said recess is generally teardrop-shaped.

10. The bit of claim 1, wherein said recess is generally V-shaped in cross section.

11. The bit of claim 1, wherein said recess is confined to the associated one of said flat surfaces.

12. In combination: a driven socket having a socket opening substantially polygonal in transverse cross section and defining socket drive surfaces, an elongated solid body substantially polygonal in transverse cross section and shaped and dimensioned to be mateably removably received in the socket opening for driven engagement by the socket drive surfaces, said body having a plurality of substantially flat planar body drive surfaces intersecting at a plurality of corners, a recess formed in at least one of said body drive surfaces, and a raised ridge of material displaced from said recess and projecting from the associated one of said body drive surfaces around substantially the entire perimeter of said recess for frictional engagement with the corresponding socket drive surface for retaining said body in the socket opening.

13. The combination of claim 12, wherein the perimeter of said recess is generally oval in shape, said recess including opposed side surfaces intersecting in a plane extending transversely of said body and being asymmetrical relative to said plane.

14. The combination of claim 12, wherein said body includes a plurality of recesses.

15. The combination of claim 13, wherein said body includes recesses respectively disposed in opposed ones of said body drive surfaces.

16. The combination of claim 14, wherein said body includes more than one of said recesses in one of said body drive surfaces.

17. The combination of claim 16, wherein said body includes more than one of said recesses in each of two opposed ones of said body drive surfaces.

18. The combination of claim 12, wherein said recess is generally conical in shape.

19. The combination of claim 12, wherein said recess is generally teardrop-shaped.

20. The combination of claim 12, wherein said recess is confined to the associated one of said body drive surfaces.

* * * * *

UNITED STATES PATENT AND TRADEMARK OFFICE

CERTIFICATE OF CORRECTION

PATENT NO. : 5,295,423

DATED : March 22, 1994

INVENTOR(S) : Frank Mikic

It is certified that error appears in the above-indentified patent and that said Letters Patent is hereby corrected as shown below:

Column 4, line 39, insert --1-- after "claim"; and line 58, "driven" should be --drive--.

Signed and Sealed this

Sixteenth Day of August, 1994

*Attest:*

*Attesting Officer*

Bruce Lehman

BRUCE LEHMAN

*Commissioner of Patents and Trademarks*